US006813888B2

(12) United States Patent
Raiko

(10) Patent No.: US 6,813,888 B2
(45) Date of Patent: Nov. 9, 2004

(54) INTEGRATION CONSTRUCTION BETWEEN A BOILER AND A STEAM TURBINE AND METHOD IN PREHEATING OF THE SUPPLY WATER FOR A STEAM TURBINE AND IN ITS CONTROL

(75) Inventor: Markku Raiko, Hyvinkää (FI)

(73) Assignee: Fortum Oyj, Espoo (FI)

( * ) Notice: Subject to any disclaimer, the term of this patent is extended or adjusted under 35 U.S.C. 154(b) by 0 days.

(21) Appl. No.: 10/250,390

(22) PCT Filed: Jan. 2, 2001

(86) PCT No.: PCT/FI01/00002

§ 371 (c)(1),
(2), (4) Date: Oct. 24, 2003

(87) PCT Pub. No.: WO02/057600

PCT Pub. Date: Jul. 25, 2002

(65) Prior Publication Data

US 2004/0050051 A1 Mar. 18, 2004

(30) Foreign Application Priority Data

Dec. 29, 2000 (FI) ..... 20002894

(51) Int. Cl.[7] ..... F01K 7/34
(52) U.S. Cl. ..... 60/653; 60/679
(58) Field of Search ..... 60/653, 679

(56) References Cited

U.S. PATENT DOCUMENTS

| | | | | |
|---|---|---|---|---|
| 3,667,217 A | | 6/1972 | Vidal et al. | 60/39.02 |
| 3,913,330 A | | 10/1975 | Horlitz, Jr. | 60/678 |
| 4,057,966 A | * | 11/1977 | Prutkovsky et al. | 60/678 |
| 4,858,562 A | * | 8/1989 | Arakawa et al. | 122/7 R |
| 4,976,107 A | | 12/1990 | Korpela | 60/670 |
| 5,038,568 A | * | 8/1991 | Gounder et al. | 60/679 |
| 5,365,730 A | * | 11/1994 | Bruckner et al. | 60/39.182 |
| 5,840,130 A | | 11/1998 | Liebig et al. | 134/22.15 |

FOREIGN PATENT DOCUMENTS

| | | |
|---|---|---|
| EP | 0037845 | 10/1981 |
| EP | 1050667 | 5/1994 |
| EP | 0724683 | 10/1994 |
| FI | 77512 | 11/1988 |
| WO | 9511370 | 4/1995 |
| WO | 101163 | 4/1998 |

* cited by examiner

*Primary Examiner*—Hoang Nguyen
(74) *Attorney, Agent, or Firm*—Steinberg & Raskin, P.C.

(57) ABSTRACT

The present invention concerns an integration construction between a steam boiler provided with a combustion chamber and a steam turbine. The steam is conducted from the steam boiler (10) along a connector to the steam turbine (11) for rotating an electric generator (G) producing electricity. The supply water circulated via the steam boiler (10) is vaporized in vaporizer (190) located in the steam boiler (10) and superheated in a superheater (120). The supply water is conducted into the boiler through an economizer (20) acting as a heat exchanger, in which heat is transferred from the flue gases of the boiler into the supply water. The economizer (20) is provided with at least two sections, comprising at least one first economizer section (20$a_1$) and at least one second economizer section (20$a_2$). The supply water preheated with bled steams of the steam turbine is conducted in the steam boiler (10) further from the economizer (20) to the vaporizer and the superheater and therethrough, in the form of steam, to the steam turbine. A connector (19) leading to the economizer sections (20$a_1$, 20$a_2$) comprises a branch point ($D_1$) to a by-pass connector (21) of supply water, whereby the economizer section (20$a_1$) can be bypassed by at least part of the supply water flow. The invention also concerns a method in preheating of the supply water for the steam turbine and in its control.

5 Claims, 1 Drawing Sheet

INTEGRATION CONSTRUCTION BETWEEN A BOILER AND A STEAM TURBINE AND METHOD IN PREHEATING OF THE SUPPLY WATER FOR A STEAM TURBINE AND IN ITS CONTROL

FIELD OF THE INVENTION

The present invention relates to an integration construction between a boiler and a steam turbine and a method in preheating the supply water for a steam turbine and in its control.

BACKGROUND OF THE INVENTION

The last heat face of a steam boiler before the smoke stack is either a flue-gas/air heat exchanger or an economizer. In the present application, a flue-gas/air heat exchanger is understood as a heat exchanger between flue gas and combustion air, in which the heat is transferred from flue gas to combustion air to preheat the combustion air. In the present application, an economizer is understood as a heat exchanger in which thermal energy is transferred from the flue gases to the supply water.

When a flue-gas/air heat exchanger is used, the supply water for the boiler can be preheated by means of bled steam from the steam turbine, whereby the efficiency of the steam turbine process is improved. A flue-gas/air heat exchanger, i.e. a heat exchanger, in which thermal energy is transferred from the flue gases directly into the combustion air, is usually not used in small steam power plants because of its high cost.

When a flue-gas/air heat exchanger is not used, the flue gases of the steam boiler are cooled before passing into the smoke stack using an economizer. In such case, the supply water cannot be preheated with the aid of the bled steam of the steam boiler because the preheating would raise the ultimate temperature of the flue gases and thereby lower the efficiency of the boiler.

In the economizer of a steam boiler, heat is transferred from the flue gases into the supply water. For a steam boiler, a steam boiler provided with a combustion chamber is used. A change in the temperature of the supply water in the economizer is lower than a change in the temperature of the flue-gas side. The temperature rise in the supply water is usually 40 to 50 percent of the respective lowering of temperature on the flue-gas side. Therefore, a difference in the temperature at the hot end of the economizer is considerably higher than at the cold end. This observation results in that, in addition to the heat obtained from the flue gases, heat from other sources can be transferred into the supply water. In a steam turbine process, it is advantageous to utilize bled steam for preheating the supply water.

The economizer of the steam boiler in a steam power plant is divided into two or more parts, the supply water being preheated in the preheaters of the high-pressure side provided between said economizer parts by the bled steam from the steam turbine.

With the aid of a connection, the integration of the steam boiler and the steam turbine process is made more efficient. By means of such arrangement, the flue gases of the steam boiler can be cooled efficiently simultaneously with enhanced efficiency of the steam turbine process.

The investment cost is lower than in an alternative provided with a flue-gas/air heat exchanger:

improved controllability and boiler efficiency smaller boiler building lower cost of the boiler.

When a flue-gas/air heat-exchanger solution is unprofitable, an improved process can be implemented with the structure since the use of bled steam can be increased.

The arrangement is preferred especially in an instance in which the combustion air of the steam boiler is heated in one or more steam/air heat exchanger(s) connected in series and utilizing bled steam.

In a prior FI patent No. 101 163, which corresponds to EP 0724683, of the applicant, the advantageous integration construction between the steam boiler and the steam turbine is known. It has proved to be useful that the temperature of the supply water flown through economizers positioned in the flue-gas duct. An amendment to the integration construction disclosed in the FI patent No. 101 163 is described in the present application.

OBJECTS AND SUMMARY OF THE INVENTION

It is disclosed in the present application that by controlling the by-pass flow of the first economizer of the preheater in a divided economizer and possibly by controlling the amount of bled steam of the preheater of supply water also in a by-pass connector, the integration degree of the steam turbine process can be controlled. The preheating is limited by the boiling temperature of the hottest economizer, and the lower limit is the closing of the bled. The control method exerts an efficient impact on the electricity production while deteriorating slightly the efficiency of the boiler when the use of bled steam exceeds the scheduled value. A change in the degree of integration is of the order 10%. A change in the efficiency of the boiler is 2 to 3% at most.

By controlling the flow portion of the supply water flowing past the economizer it is possible (a) to control the ultimate temperature of the flue gas of the boiler as the power of the boiler changes and as the quality of the fuel varies (b) to control the ultimate temperature of the supply water so that the ultimate temperature of the supply water after the economizer is as desired (being e.g. 10 to 20° C. below the boiling temperature).

Particularly when a soda recovery boiler is in question, the flue gases are highly soiling and corroding, and therefore, the soda recovery boilers cannot be provided with a flue-gas/air heat exchanger. The flue gases of the boiler are cooled by supplying supply water at about 120° C. into the boiler. The preheating of the combustion air is important because of the combustion of black lye and therefore, the combustion air is heated with the aid of plant steam, typically to about 150° C.

The above integration is not optimal considering the steam turbine process and therefore, the electricity power obtained from a back-pressure turbine will be low. As regards the boiler, an optimal situation prevails when the temperature of the flue gases exiting the boiler is as low as possible and no excessive soiling and corrosion of the heat faces is taking place yet. When the supply water into the boiler is in constant temperature, the temperature of the flue gases varies in accordance with the power level, the quality of fuel and the soiling situation of the heat faces. An optimal temperature is reached only occasionally on partial powers.

As described above, the optimal manner of driving the boiler is reached by integrating a soda recovery boiler and the steam turbine process as follows. The combustion air is preheated, instead of the plant steam, with bled steams of the steam turbine to about 200° C., and a connector is connected between the economizers positioned in the flue gas duct of the boiler from the supply water preheater using bled steam. By controlling the temperature of the supply water entering into the boiler with the aid of the amount of the bled steam passing through the by-pass duct into the preheater and/or by controlling simultaneously the temperature of the supply water so that the amount of bled steam entering into the preheater is controlled, the ultimate temperature of the boiler flue gases can be controlled as desired in all running situations.

The integration construction between a steam boiler and a steam turbine of the invention in controlling the temperature of the supply water of the steam turbine is characterized in what is presented in the claims.

BRIEF DESCRIPTION OF THE DRAWINGS

The invention is described below referring to the advantageous embodiments of the invention illustrated in the drawings of the accompanying figures, whereto, however, the invention is not intended to be exclusively confined.

DETAILED DESCRIPTION OF TILE INVENTION

Figure 1:
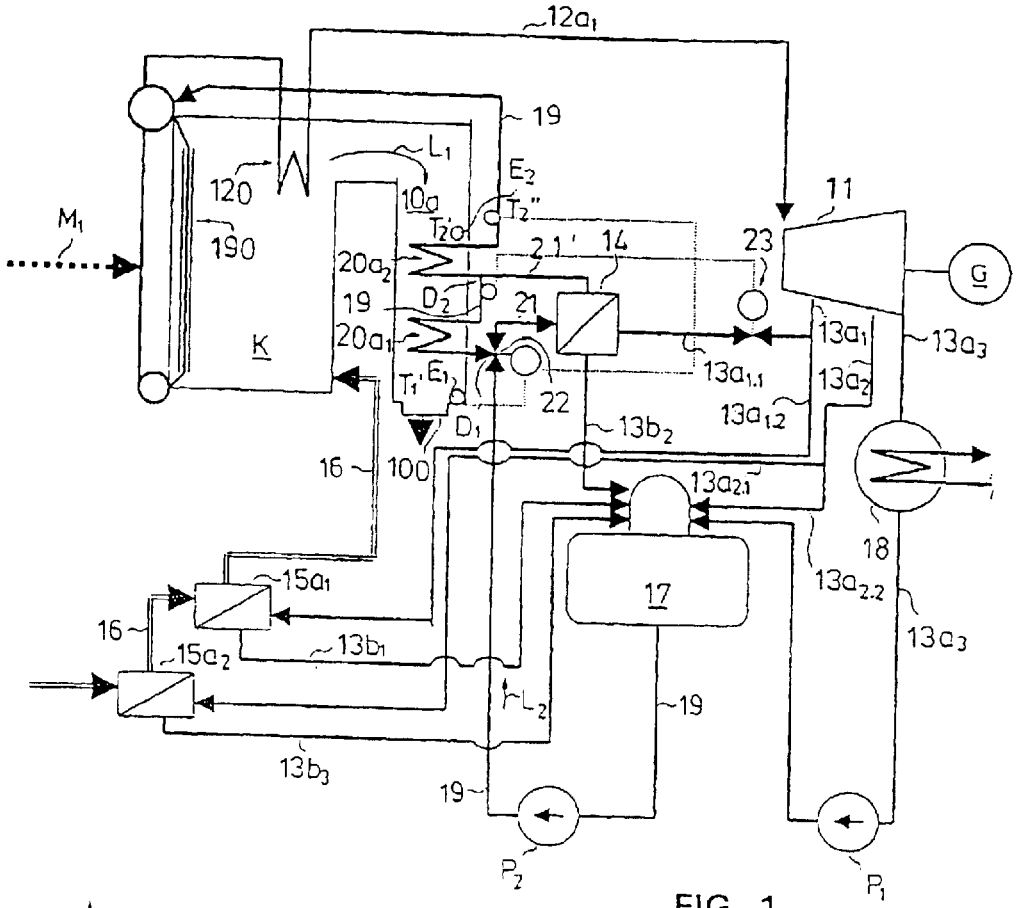
FIG. 1 presents as a schematic diagram an integration construction between a boiler and a steam turbine.

FIG. 1 presents an integration construction of the invention between a boiler and a steam turbine, comprising a steam boiler, such as soda recovery boiler, to which fuel is brought as shown by arrow $M_1$. The boiler is indicated by reference numeral 10. The evaporator is indicated by reference numeral 190 and the superheater thereafter in a connector 12$a_1$ by reference numeral 120. The flue gases are discharged during a second draught 10$a$ from the boiler 10 into a smoke stack 100 and therethrough into the outside air as shown by arrow $L_1$. The second draught 10$a$ is the part of the boiler which comprises the heat faces prior to the smoke stack 100. The superheated steam is conducted to the steam turbine 11 along the connector 12$a_1$ and the steam turbine 11 is arranged to rotate a generator G producing electricity. From the steam turbine 11, connectors 13$a_1$ and 13$a_2$ are provided for bled steams and a connector 13$a_3$ into a condensator 18 for exit steam or back-pressure steam entering into the industrial process. The connector 13$a_1$ is branched into branch connectors 13$a_{1.1}$and 13$a_{1.2}$, of which the connector 13$a_{1.1}$ conducts the supply water running in the connector 19 to a preheater 14 and the connector 13$a_{1.2}$ conducts the combustion air to a preheater 15$a_1$ which is provided with a return connector 13$b_1$ to a supply water tank 17. From the preheater 14 of the supply water, a return connector 13$b_2$ is provided into the supply water tank 17. The combustion air is conducted along a connector or an air duct 16 via combustion air preheaters 15$a_1$ and 15$a_2$ in series into the combustion chamber K of the boiler.

In the integration construction, the temperature of the supply water is continuously raised in a first economizer section 20$a_1$ and from the first economizer section 20$a_1$ to a second economizer section 20$a_2$. In the preheater 14, the supply water is heated with the aid of thermal energy obtained from bled steams.

From the steam turbine 11, a connector 13$a_2$ for bled steam is furthermore provided, being branched into branch connectors 13$a_{2.1}$, 13$a_{2.2}$. The connector 13$a_{2.1}$ leads to a second combustion air preheater 15$a_2$. From the air preheater 15$a_2$, a discharge connector 13$b_3$ is provided into the supply water tank 17. The connector 13$a_{2.2}$ leads to the supply water tank 17. A discharge steam connector 13$a_3$ of the steam turbine 11 is lead to a condensator 18. On the trailing side of the condensator 18 the connector 13$a_3$ is provided with a pump $P_1$ to pump water into the supply water tank 17 from the condensator 18.

A pump $P_2$ is connected to a connector 19 leading from the supply water tank 17 to a first economizer section 20$a_1$ of the economizer 20 in the flue-gas duct 10$a$, said first economizer section 20$a_1$ being further connected to a second economizer section 20$a_2$, which economizer sections 20$a_1$ and 20$a_2$ are in this manner in series in relation to each other and between which economizer sections 20$a_1$ and 20$a_2$, a connector 21' is connected, being conducted to a branch point $D_2$ from the supply water preheater 14, to provide the energy from the bled steam. The economizer 20 is made at least of two sections. The flow direction of the supply water in the connector 19 is denoted by arrow $L_2$. The supply water in the connector 19 is made to flow to the first economizer section 20$a_1$ and therefrom to the second economizer section 20$a_2$ or via a by-pass connector 21 to the supply water preheater 14 and therefrom into the connector 19 between the first economizer section 20$a_1$ and the second economizer section 20$a_2$. The first economizer section 20$a_1$ and the second economizer section 20$a_2$ are connected in series in relation to each other.

Prior to the economizer section 20$a_1$, the connector 19 includes a branch point $D_1$ for a by-pass connector or a by-pass duct 21, wherewith the economizer section 20$a_1$ positioned first relative to the supply water flow is by-passed. Thus, said economizer section 20$a_1$ is bypassable and the supply water is conductable directly to the second economizer section 20$a_2$ and preferably, through the supply water preheater 14. The branch point $D_1$ comprises advantageously a distribution valve 22 for the supply water flow, which can be a three-way valve, that is, the flow is controlled therewith between the economizer section 20$a_1$ and the by-pass duct, i.e. the by-pass connector 21. Using the valve 22, the by-pass flow of the economizer section 20$a_1$ can therefore be controlled as desired to conform to the running conditions of the boiler. The connector 19 is in this manner connected to the distribution valve 22 having an outlet to the by-pass connector 21, which is connected to the preheater 14, and a second outlet, which is connected to the first economizer section 20$a_1$. The connector 21' from the preheater 14 is connected via a branch point $D_2$ to the connector 19 between the economizer sections 20$a_1$ and 20$a_2$.

The valve 22 can be an on/or valve in structure, so that the entire supply water quantity of the connector 19 is made to flow either through the by-pass connector 21 or through the economizer section 20$a_1$, or the valve 22 can be a so-called proportional valve in structure, whereby, when the by-pass flow through the by-pass connector 21 is increased, the flow through the economizer section 20$a_1$ is reduced by an equal amount, however, to the extent that some of the flow passes through the economizer section 20$a_1$ and other part thereof passes through the by-pass connector 21.

By controlling the amount of bled steam to the preheater 14 with a valve 23, the temperature of the supply water can be regulated intensively to be as desired in different parts of the economizer 20 including several portions in different running conditions of the boiler 10. In the preheater 14, the thermal energy passes from the led steam directly to the supply water or either indirectly through a medium, for instance via water. The preheater 14 is thus a heat exchanger in which heat energy is transferred into the supply water.

Figure 2:
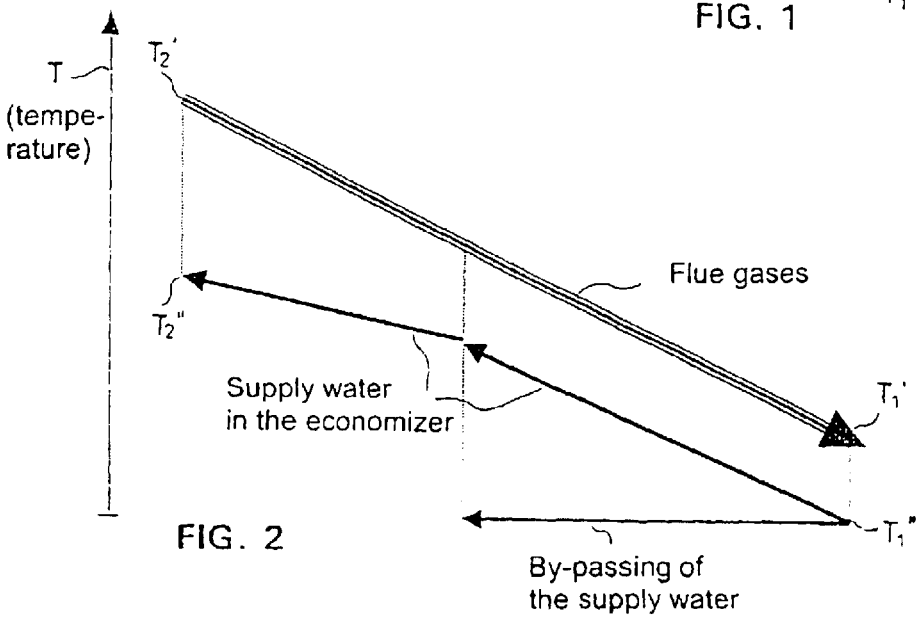
FIG. 2 presents a decrease of the flue-gas temperature in a flue-gas duct and an increase of temperature in the supply water of an economizer in a control of the invention.

In FIG. 2, the ascending angle of the cold economizer changes as a main impact of the control. The by-pass is illustrated by a horizontal graph. The temperature of the supply water can be controlled as desired in different spots of the economizer sections 20$a_1$, 20$a_2$. On the inlet side of the economizer section 20$a_1$ and on the outlet side of the flue-gas duct 10*a*, the flue-gas temperature is marked by $T_1'$ and the temperature of the supply water by $T_1''$. On the outlet side of the second economizer section 20$a_2$ and on the inlet side of the flue-gas duct the markings of FIG. 2 are as follows: the flue-gas temperature is $T_2'$ and the supply water temperature is $T_2''$. The flue-gas duct 10*a* may comprise temperature sensors: a temperature sensor $E_2$, measuring the temperature on the inlet side of the flue-gas duct (viewing in the flow direction $L_1$ of the flue gas), and a temperature sensor $E_1$, measuring the temperature of the flue gas on the outlet side of the flue-gas duct 10*a*. In addition, the apparatus may comprise temperature sensors in the connector of the supply water 19. Temperature can be measured from the supply water after the first economizer section 20$a_1$ before the second economizer section 20$a_2$ and from the supply water after the second economizer section 20$a_2$ when viewed in the flow direction $L_2$ of the supply water. The flow direction of the supply water in the connector 19 is marked by arrow $L_2$.

In the method, in preheating the supply water of the steam turbine and in its control, the procedure is as follows. The supply water is conducted into an economizer 20 of the steam boiler 10 provided with a combustion chamber K, in which heat is transferred in a heat exchanger from the flue gases into the supply water. The economizer 20 by its heat faces is arranged to be positioned, at least in part, in a flue-gas duct 10*a* of the steam boiler 10. At least a two-portion economizer 20$a_1$, 20$a_2$ is used for heating the supply water, said portions being in series. The supply water preheated with the aid of bled steams is conducted to a second economizer section 20$a_2$ and further to a vaporizer 190 and a superheater 120 and further, in the form of steam, to the steam turbine 11 to rotate the electric generator G and to produce electricity. In the method, also the combustion air is heated with the aid of the energy acquired from bled steams. In the method, the by-pass quantity of the supply water of the economizer 20 is controlled with a valve 22. In addition to the by-pass, the amount of bled steam flow flown into the preheater 14 of the supply water is controlled with a valve 23. In the method, the valve(s) 22 and/or 23 is/are controlled on the basis of temperature measurement of supply water flown through temperature measurement of flue gases and/or the economizer 20.

What is claimed is:

1. An integration construction between a steam boiler and a steam turbine provided with a combustion chamber, comprising:

a connector structured and arranged to conduct steam from the steam boiler(10) to the steam turbine (11) for rotating an electric generator (G) generating electricity, a vaporizer (190) located in the steam boiler (10), said vaporizer (190) is structured and arranged to vaporize a supply water being circulated through the steam boiler (10) and superheated in a superheater (120), an economizer (20) acting as a heat exchanger, in which heat is transferred from the flue gases of the boiler into the supply water, and the supply water is conducted into the boiler through the economizer (20), wherein the economizer (20) is provided with at least two sections, comprising at least one first economizer section (20$a_1$) and at least one second economizer section (20$a_2$), which are in series, wherein the supply water being preheated with bled steams of the steam turbine is conducted in the steam boiler (10) further to the vaporizer (190) and the superheater (120) and therethrough, in the form of steam, to the steam turbine (11), another connector (19) leading to the economizer sections (20$a_1$, 20$a_2$) comprises a first branch point ($D_1$) to a by-pass connector (21) of supply water, so that the at least one first economizer section (20$a_1$) is by-passable, at least concerning part of the supply water flow, and wherein the by-pass connector (21) is connected to a preheater (14) of supply water and that from the preheater (14) a connector (21') leads through a second branch point ($D_2$) to the another connector (19) between the economizer sections (20$a_1$ and 20$a_2$) and that bled steam is conducted to the preheater (14) of supply water from the steam turbine (11).

2. The integration construction according to claim 1, wherein the first branch point ($D_1$) comprises a distribution valve (22), wherewith the supply water flow can be controlled between the at least one first economizer section (20$a_1$) and the by-pass connector (21).

3. The integration construction according to claim 1, wherein a branch connector (13$a_{1.1}$) leading to the supply water preheater (14) comprises a second valve (23) for controlling the amount of bled steam flow to the preheater (14).

4. A method in preheating of a supply water for a steam turbine and in its control, comprising the steps of:

conducting the supply water into an economizer (20) of a steam boiler (10) provided with a combustion chamber (K), in which heat is transferred in a heat exchanger from the flue gases into the supply water, arranging the economizer (20), at least partly by its heat faces, in a flue-gas duct (10*a*) of the steam boiler (10), wherein the economizer includes at least two sections (20$a_1$, 20$a_2$) being used for heating the supply water, said sections being in series in relation to each other, heating combustion air with the aid of the energy obtained from bled steams, and controlling an amount of a by-pass flow of the supply water of the economizer (20) with a first valve (22), wherein in addition to the by-pass flow, controlling the amount of bled steam flow made to flow into a supply water preheater (14) in a by-pass flow connector (21) with a second valve (23), and providing a connector (21') from the preheater (14) being connected via a branch point ($D_2$) to be in the line (19) between the economizer sections (20$a_1$, 20$a_2$).

5. The method according to claim 4, wherein the first valve (22) and/or the second valve (23) is/are controlled on the basis of the temperature measurement of the flue gases and/or of the supply water made to flow through the economizer (20).

* * * * *